US011795734B2

(12) United States Patent
Szarka-Kovacs

(10) Patent No.: US 11,795,734 B2
(45) Date of Patent: Oct. 24, 2023

(54) PADLOCK

(71) Applicant: TNBT Holdings Pty Ltd, Minchinbury (AU)

(72) Inventor: Zsolt Szarka-Kovacs, Dee Why (AU)

(73) Assignee: TNBT Holdings Pty Ltd, Minchinbury (AU)

( * ) Notice: Subject to any disclaimer, the term of this patent is extended or adjusted under 35 U.S.C. 154(b) by 306 days.

(21) Appl. No.: 17/164,003

(22) Filed: Feb. 1, 2021

(65) Prior Publication Data

US 2021/0254370 A1 Aug. 19, 2021

(30) Foreign Application Priority Data

Feb. 13, 2020 (AU) ..... 2020900399
Nov. 10, 2020 (AU) ..... 2020267185

(51) Int. Cl.
*E05B 67/24* (2006.01)
*E05B 35/08* (2006.01)

(52) U.S. Cl.
CPC ..... *E05B 67/24* (2013.01); *E05B 35/08* (2013.01)

(58) Field of Classification Search
CPC ..... E05B 35/08; E05B 35/10; E05B 35/105; E05B 67/06; E05B 67/22; E05B 67/24
See application file for complete search history.

(56) References Cited

U.S. PATENT DOCUMENTS 912,773 A * 2/1909 Augenbraun ..... E05B 67/24 70/52
1,256,721 A 2/1918 Murray
2,487,608 A 11/1948 Soref et al.
2,834,195 A * 5/1958 Stackhouse ..... E05B 67/24 70/423
3,581,530 A 6/1971 Raspadori
3,813,905 A * 6/1974 Sauder ..... E05B 35/08 70/383
4,655,062 A 4/1987 Kaufman
5,839,302 A * 11/1998 Chu ..... E05B 35/12 70/38 A (Continued)

FOREIGN PATENT DOCUMENTS

DE 202010010397 U1 11/2010
JP 2002168026 A 11/2002

OTHER PUBLICATIONS

AU 2020267185, Examination report No. 1, issued Jun. 10, 2021, 10 pages.

(Continued)

*Primary Examiner* — Christopher J Boswell
(74) *Attorney, Agent, or Firm* — Phillips Nizer LLP; Jason Plotkin

(57) ABSTRACT

Disclosed herein is a lock comprising a movably housed shackle stop, a shackle that is movably mounted and a shackle stop receiver for receiving the shackle stop to immobilise the shackle. The lock includes a shackle stop actuator is pivotable around a laterally orientated pivot axis and comprises a lateral cam surface configured to outwardly move the shackle stop into receipt by the shackle stop receiver. The lock includes a body configured to simultaneously receive a plurality of cylinder locks for actuation of the shackle stop actuator by any one of the plurality of cylinder locks.

19 Claims, 11 Drawing Sheets

(56) References Cited

U.S. PATENT DOCUMENTS

| | | | | |
|---|---|---|---|---|
| 7,856,855 | B2 * | 12/2010 | Fantl | E05B 67/063 70/38 A |
| 9,200,473 | B2 * | 12/2015 | Fan | E05B 67/24 |
| 10,267,066 | B2 * | 4/2019 | Fan | E05B 67/063 |
| 2002/0184930 | A1 * | 12/2002 | Segawa | E05B 35/08 70/208 |
| 2010/0154487 | A1 * | 6/2010 | Cheung | E05B 67/24 70/35 |

OTHER PUBLICATIONS

U.S. Pat. No. 474783A, titled Lock, issued May 10, 1982, invented by W.H. Taylor, 4 pages.
EPO search report application 21152090.3, dated Aug. 25, 2021, 63 pages.
U.S. Pat. No. 912773A, titled Duplex or Master key Lock, issued Feb. 16, 1909, invented by P.F. Augenbraun, 3 pages.
English abstract of DE202010010397U1, 1 page.
English abstract of JP2002168026A, 1 page.

* cited by examiner

PADLOCK

CROSS REFERENCE OF RELATED APPLICATIONS

The present application is related to and claims priority to Australian Provisional Patent Application, entitled "A Padlock," which was filed on Feb. 13, 2020 and assigned No. 2020900399, which is hereby incorporated by reference in its entirety. The present application is also related to and claims priority to Australian Patent Application No. 2020267185, filed Nov. 10, 2020, which is hereby incorporated by reference in its entirety.

TECHNICAL FIELD

The disclosure herein generally relates to padlocks.

BACKGROUND

A gate, for example, may be locked with a padlock. Agents of unrelated entities in the form of a water company worker and an electrical distribution company worker, for example, may wish to unlock the padlock on the gate at different and uncoordinated times. This may require that the different entities have identically cut keys, which may be inconvenient or require an unrealistic level of cooperation between the entities. If one of the entities changes the key coding for the padlock, the other party may cease to be able to unlock the padlock. It may be desirable to have a padlock that can be more conveniently used by different parties. It may be desirable to have a padlock that may have improved strength.

SUMMARY

Disclosed herein is a padlock. The padlock comprises a movably housed shackle stop. The padlock comprises a shackle that is movably mounted and comprising a shackle stop receiver for receiving the shackle stop to immobilise the shackle. The padlock comprises a shackle stop actuator pivotable around a laterally orientated pivot axis and comprising a lateral cam surface configured to outwardly move the shackle stop into receipt by the shackle stop receiver. The padlock comprises a body configured to simultaneously receive a plurality of cylinder locks for actuation of the shackle stop actuator by any one of the plurality of cylinder locks.

An embodiment comprises the plurality of cylinder locks and a plurality of cylinder lock cams. The shackle stop may be movably disposed in a conduit having a first conduit opening and a second conduit opening. The shackle stop receiver may be positionable at the first conduit opening and when so positioned the shackle stop is movable along the conduit into receipt by the shackle stop receiver for immobilising the shackle. The lateral cam surface may be configured to move the shackle stop to the first conduit opening. Each of the plurality of cylinder lock cams may be cooperatively arranged with their respective cylinder lock to be in contact with the shackle stop actuator at the same time as the respective cylinder lock has captured a key and the stop actuator is at the second position.

An embodiment comprises a plurality of cylinder lock cams receivable by the body. Each of the plurality of cylinder lock cams when so received may be operable by the plurality of cylinder locks, when so received by the body, to pivot the shackle stop actuator. Each of the plurality of cylinder lock cams may comprise a finger for contact with the shackle stop actuator. The finger may be perimetrically located.

An embodiment comprises another movably housed shackle stop, the shackle comprising two arms wherein one arm comprises the shackle stop receiver and the other arm comprises another shackle stop receiver for receiving the other shackle stop and immobilising the shackle. The two arms may be perpendicular to the laterally extending pivot axis.

In an embodiment, the body may define a plurality of cylinder lock cavities for receiving the plurality of cylinder locks.

In an embodiment, a longitudinal axis of each of the plurality of cylinder lock cavities are substantially perpendicular to the laterally extending pivot axis.

In an embodiment, the plurality of cylinder locks are removably fixed within the plurality of cylinder lock cavities.

In an embodiment, the shackle stop comprises a ball.

In an embodiment, the shackle stop is movably disposed in a conduit having a first conduit opening and a second conduit opening;

the shackle stop receiver is positionable at the first conduit opening and when so positioned the shackle stop is movable along the conduit into receipt by the shackle stop receiver for immobilising the shackle;

wherein the lateral cam surface is configured to move the shackle stop to the first conduit opening.

An embodiment comprises a plurality of cylinder lock cams receivable by the body and each of the plurality of cylinder lock cams when so received are operable by the plurality of cylinder locks, when so received by the body, to pivot the shackle stop actuator. Each of the plurality of cylinder lock cams may comprise a camming surface followed by the shackle stop actuator.

An embodiment comprises the plurality of cylinder locks to which the plurality of cylinder lock cam are actuatably coupled thereto, wherein the shackle stop actuator is cooperatively arranged with each of the plurality of cylinder lock cams for pivoting the shackle stop actuator.

In an embodiment, the shackle stop actuator is pivotable between a first position and a second position wherein the distance between the lateral cam surface and the second conduit opening when the stop actuator is at the second position is greater than that when the stop actuator is at the first position.

An embodiment comprises a biasing element cooperatively coupled to the shackle stop actuator, and which biases the shackle stop actuator to the first position.

In an embodiment, the shackle stop actuator is pivotable to a third position wherein the distance between the lateral cam surface and the second conduit opening when the stop actuator is at the third position is greater than that when the stop actuator is at the first position.

In an embodiment, the shackle stop actuator is pivotable to the second position by operation by one of the plurality of cylinder locking.

In an embodiment, the plurality of cylinder lock cams comprise a plurality of follower engages and the shackle stop actuator comprises a plurality of cylinder lock cam following surfaces. The plurality of cylinder lock cam following surfaces may be rounded, elongated and on opposite sides of the shackle stop actuator.

Any of the various features of each of the above disclosures, and of the various features of the embodiments described below, can be combined as suitable and desired.

BRIEF DESCRIPTION OF THE FIGURES

Embodiments will now be described by way of example only with reference to the accompanying figures in which.

DESCRIPTION OF EMBODIMENTS

Figure 2:
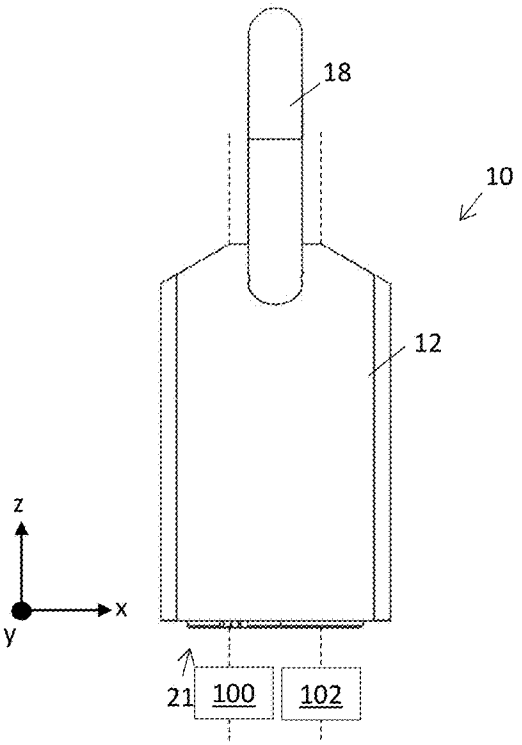
FIGS. 1, 2, and 3 show front elevational, side elevational and bottom views of an embodiment of a padlock in a locked state, in which a shackle of the padlock is fixed.
Figure 3:
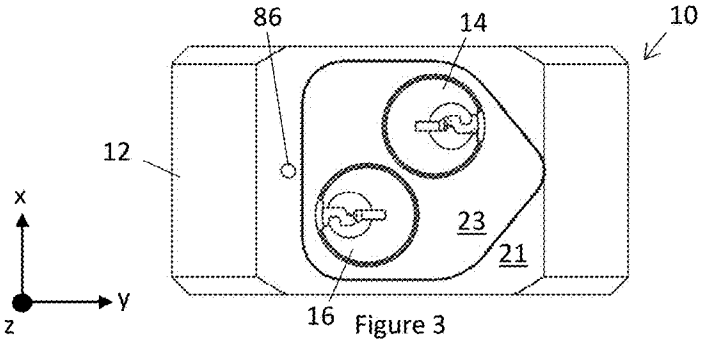
Figure 1:
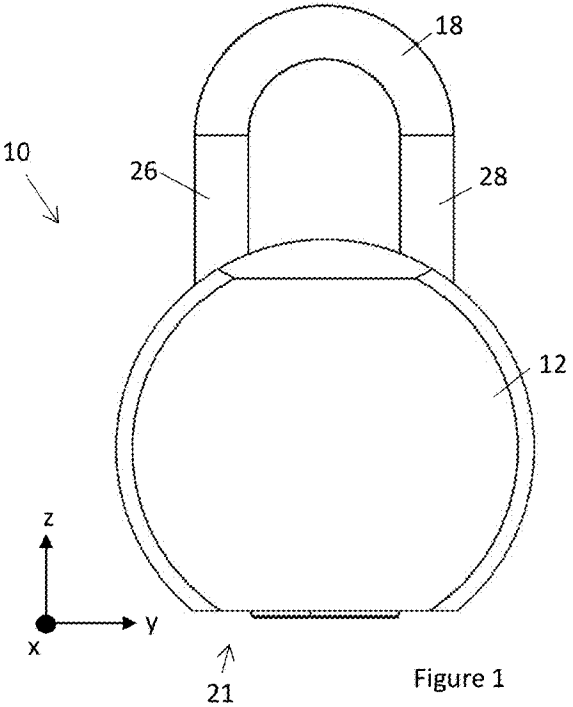
Figure 5:
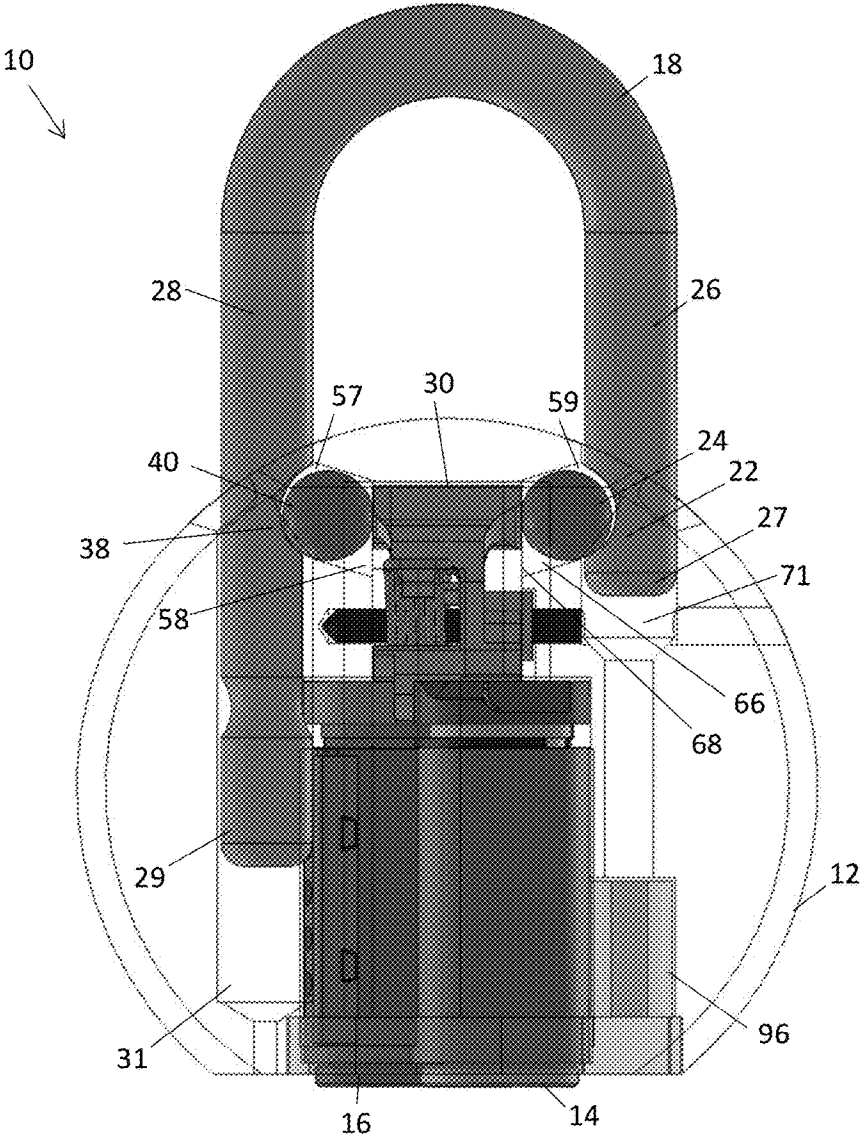
FIG. 5 shows a rear elevational view of the padlock of FIG. 1 in the locked state with the body shown transparently.
Figure 4:
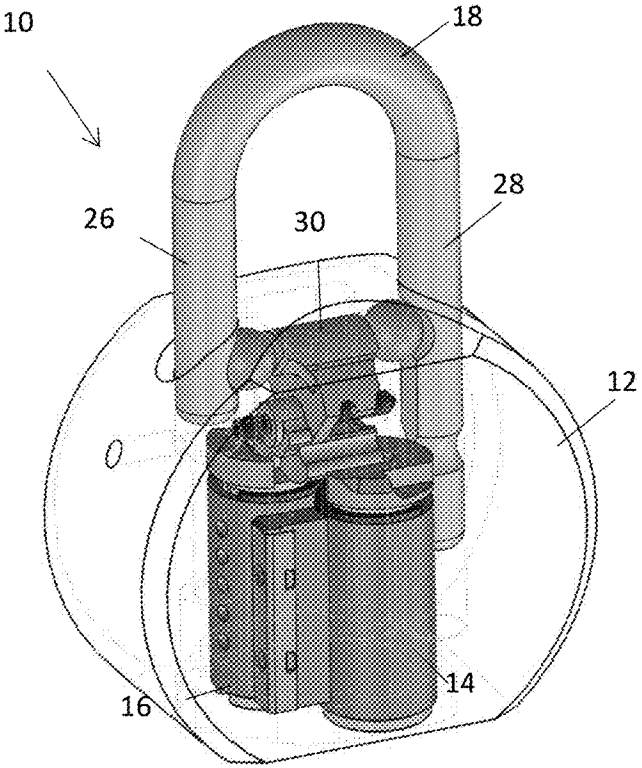
FIG. 4 shows the arrangement of the internal components of the padlock of FIG. 1 in the locked state.
Figure 7:
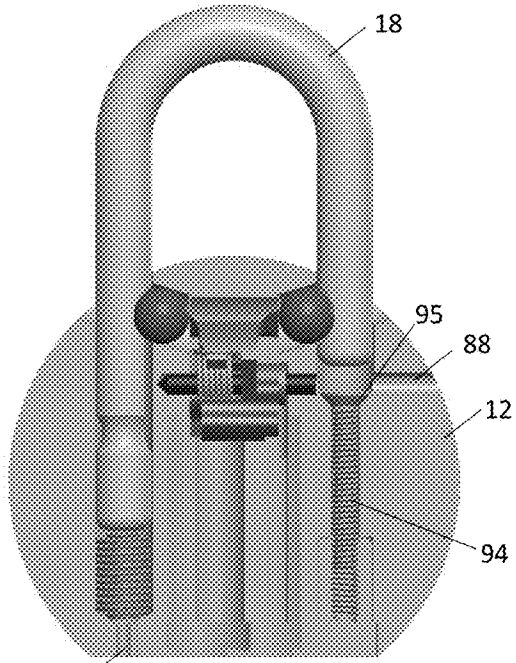
FIGS. 7 and 8 show cut away elevational views of the padlock of FIG. 1 with some parts removed.
Figure 6:
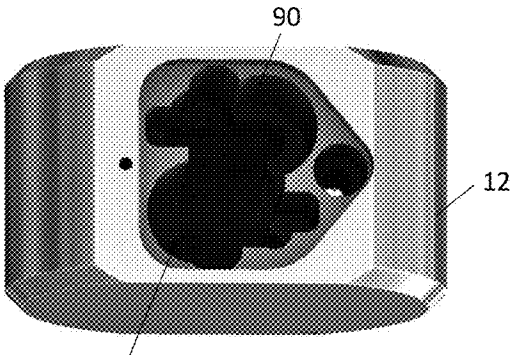
FIG. 6 shows a bottom view of the padlock of FIG. 1 with some parts removed.
Figure 8:
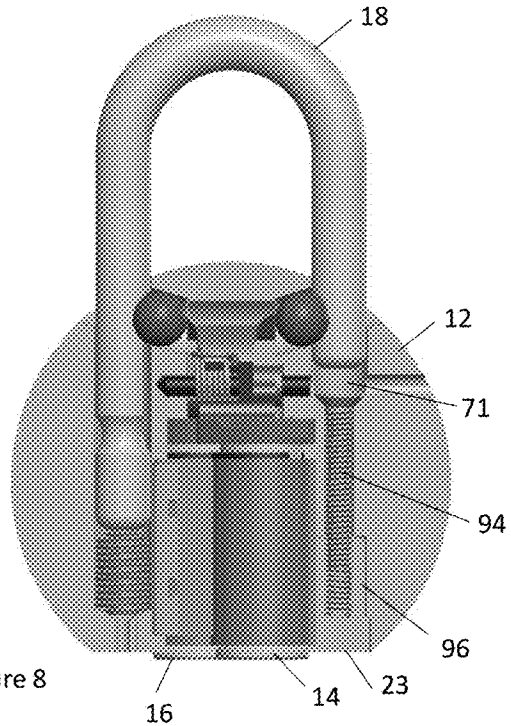

FIGS. 1, 2, and 3 show front elevational, side elevational and bottom views of an embodiment of a padlock in a locked state, the padlock being generally indicated by the numeral 10. The padlock 10 comprises a body 12 configured to simultaneously receive a plurality of cylinder locks comprising a first cylinder lock 14 and a second cylinder lock 16. FIGS. 4 and 5 show the arrangement of the internal components of the padlock of FIG. 1 in the locked state, with some parts hidden or shown transparently. FIGS. 6 and 7 respectively show a bottom view and cut away elevation views of the padlock 10 with a cavity closure 23, first cylinder lock 14 and second cylinder lock 16 removed to reveal a plurality of cylinder lock cavities 90,92 which a connected by a passageway to form a single cavity. As shown in FIG. 8, the cavity closure 23 is in use fastened by fastener 94 in the form of a screw disposed in bore 71 and engaged by threaded portion 96 of the cavity closure 23. The plurality of cylinder locks 14, 16 are shown in FIG. 8 as being received by the body 12 and disposed within the plurality of cylinder lock cavities 90, 92 defined by the body 12. In this embodiment, the cylinder locks 14,16 are removably fixed and have been inserted through a base 21 of the padlock 10. A longitudinal axis 100, 102 of each of the plurality of cylinder locks, which are elongated, are shown aligned with a z direction. The plurality of cylinder lock cavities defined by the body 12 are elongated in the z direction and share the longitudinal axes 100,102 with their associated cylinder lock when the cylinder locks 14,16 are received. An alternative and otherwise identical embodiment of a padlock is not provided with cylinder locks. The cylinder locks 14,16 may be provided for separately. Also shown in FIG. 3 is drainage hole 86.

Figure 11:
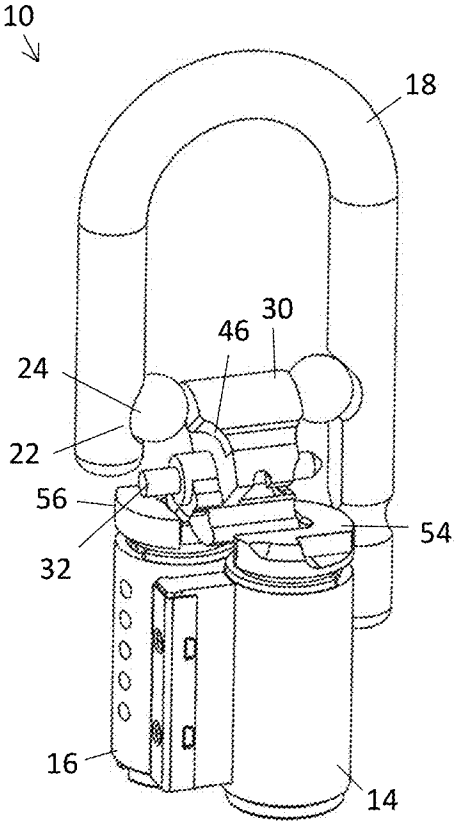
FIGS. 9 to 11 show front elevation, side elevation and isometric views respectively of the padlock of FIG. 1 in the locked state, with some parts hidden and revealing internal components.
Figure 10:
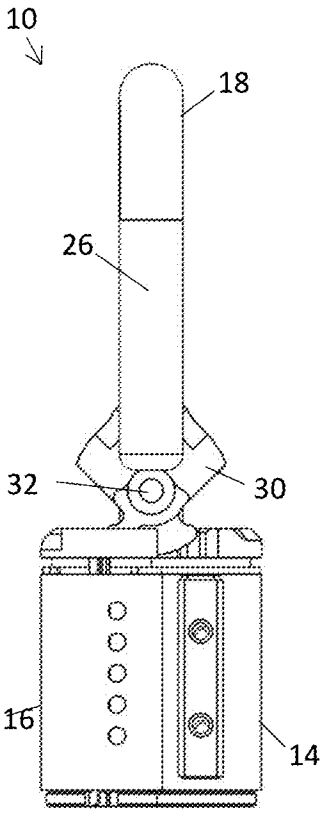
Figure 9:
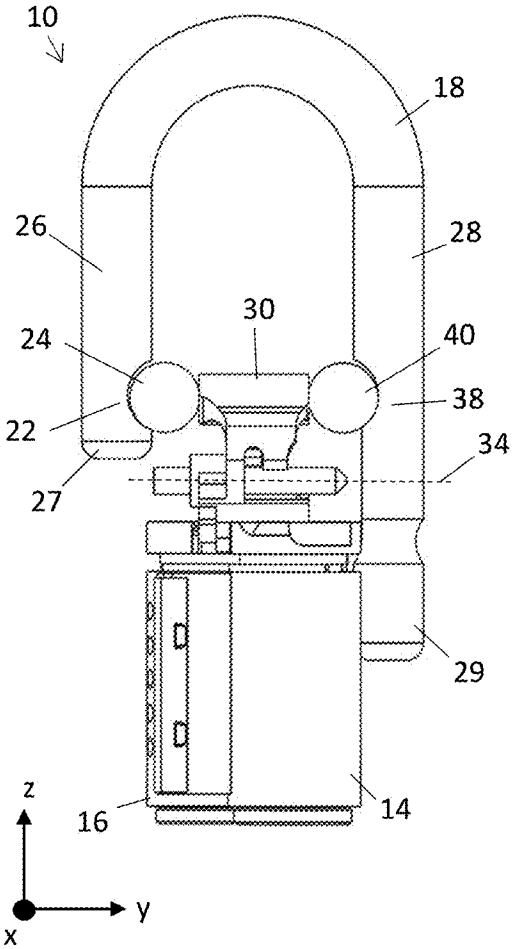

FIGS. 9 to 11 show front elevation, side elevation and isometric views respectively of the padlock of FIG. 1 in the locked state, with some parts hidden and revealing internal components. The padlock 10 comprises a shackle 18 in the form of a steel or other metal bar that is turned back on itself to define two arms 26, 28 that respectively terminate at an end in the form of the shackle toe 27 and another end in the form of a shackle heel 29. The two arms 26,28 are shown extending in a z direction. The padlock 10 is in a locked state in FIGS. 1 to 7, in which the shackle 18 of the padlock 10 in fixed or locked.

Figure 13:
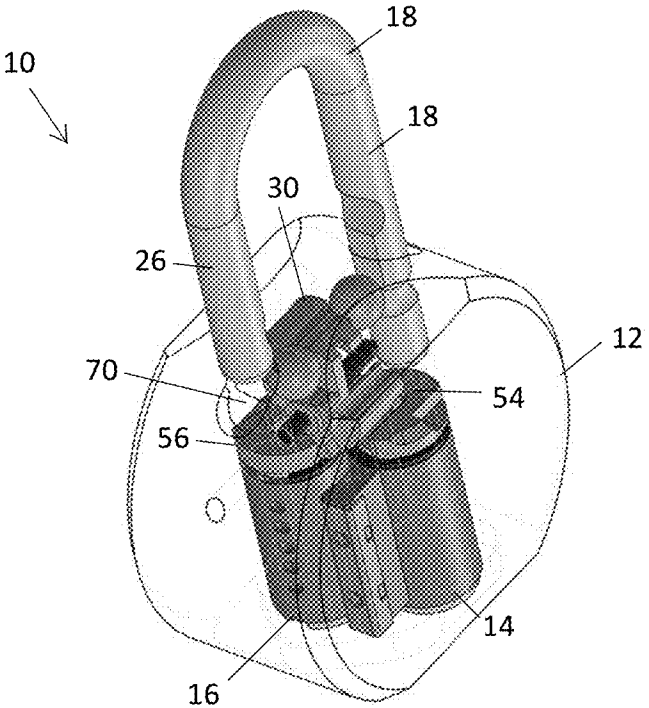
FIGS. 12 and 13 shows the arrangement of the internal components of the padlock of FIG. 1 in an unlocked state with the shackle extended outwardly, wherein the separation of the shackle from the body is being stopped, with some parts hidden or transparently shown.
Figure 12:
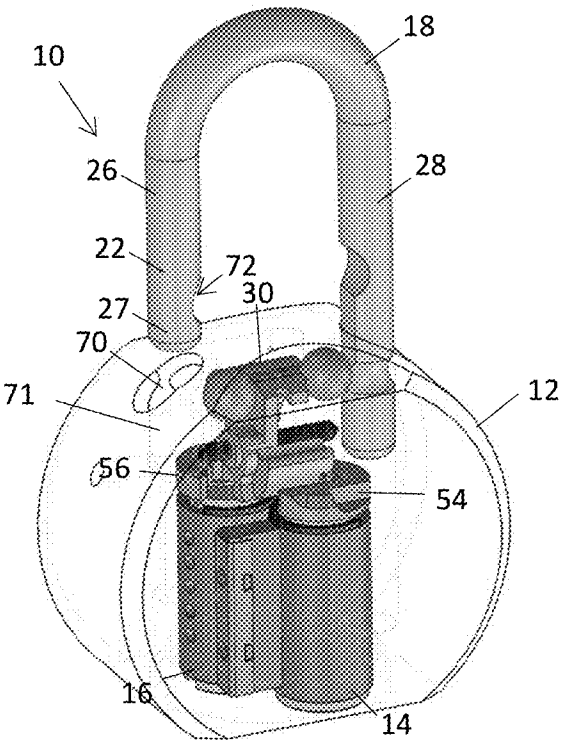

As shown in FIGS. 12 and 13, in which the padlock 10 is in an unlocked state and an end 27 of the shackle 18 is withdrawn from a shackle heel receiving bore 71 defined by the body 12, the shackle 18 is movably mounted to the body 12 such that the end of arm 26 can be withdrawn from the body 12 by an outwardly translation in substantially the z direction. The end 27 can be inserted into the body 12 via a shackle aperture 70 defined by body 12 and captured within the body 12 by a lock mechanism within the body 12. The arm 26 can be released by key operation of any one of the plurality of cylinder locks 14,16, which are generally but not necessarily differently cut—for example having different key codes (e.g. blind or bitting codes). The padlock 10 may be used, for example, to secure a gate that may need to be opened by agents from two different organisations (e.g. a power company and a water company). A key for one of the cylinder locks 14 may be in the possession of one company and a key for the other cylinder lock 16 may be in the possession of another company.

As shown in FIGS. 9 and 10, the shackle 18 comprises a shackle stop receiver 22 by which is received a shackle stop 24. The padlock 10 has two shackle stops 24,40 and two shackle stop receivers 22, 38 that operate similarly. The shackle stops 24,40 will now be described with reference to only one shackle stop 24 and one shackle stop receiver 22 with the understanding that the description generally applies to both shackle stop receivers 22,38 and both shackle stops 24,40. The shackle stop 24 and other shackle stop 40 are each in the form of a sphere and in the present embodiment comprises steel or alternatively another metal, ceramic or generally any suitable material ("ball bearing"). The shackle stop receiver 22 comprises a section of the shackle 18 that defines a recess 72 (FIG. 12, for example) in the form of a curved groove for the shackle stop 24. The shackle stop 24 interferes with the shackle 18 when in the stop position as shown in FIGS. 9 and 11, and so immobilises it. This prevents the end of arm 26 from being withdrawn from the body 12 and the padlock 10 being configured in an unlocked state. The recess 72 may be formed by broaching, grinding or milling a shackle blank, for example.

The padlock 10 comprises a shackle stop actuator 30, as seen in FIGS. 9 to 11 and detailed in FIGS. 11 to 15. The shackle stop actuator 30 is pivotably mounted by a removable pivot pin 32 that is laterally orientated (shown parallel to a y direction) and so pivotable around a laterally orientated pivot axis 34 shown in FIG. 4. The pivot pin 32 is disposed in aperture 35 (FIG. 21) defined by the shackle stop actuator 30, having been inserted through drainage hole 88 shown in FIG. 7 and retained by interference with fastener 94, in this but not all embodiments a head 95 of fastener 94. The shackle stop actuator is pivotable between a plurality of pivot positions. The shackle stop actuator 30 is operationally coupled to each of the plurality of cylinder locks 14,16 and actuatable by each of the plurality of cylinder locks 14,16 to pivot the shackle lock actuator 30. The shackle stop actuator 30 is pivotable between a plurality of positions. A biasing element 42 in the form of a torsion spring is operationally coupled to the shackle stop actuator 30 and the body 12 and is arranged to urge the shackle stop actuator 30 to a pivot position that is a central, locking, or first pivot position, as shown in FIGS. 4,5,9 and 10, for example, that is between two other pivot positions (one of which may be a second pivot position). The pin 32 may be integral with the shackle stop actuator 30.

Figure 18:
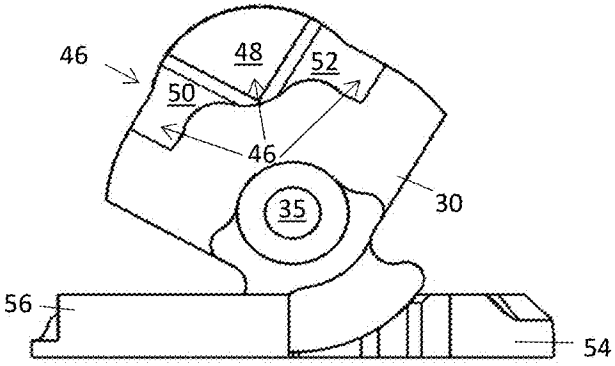
FIG. 18 shows an elevational side view of the side of the shackle stop actuator of FIG. 11 and two cylinder lock cams of the padlock of FIG. 1 associated therewith.
Figure 19:
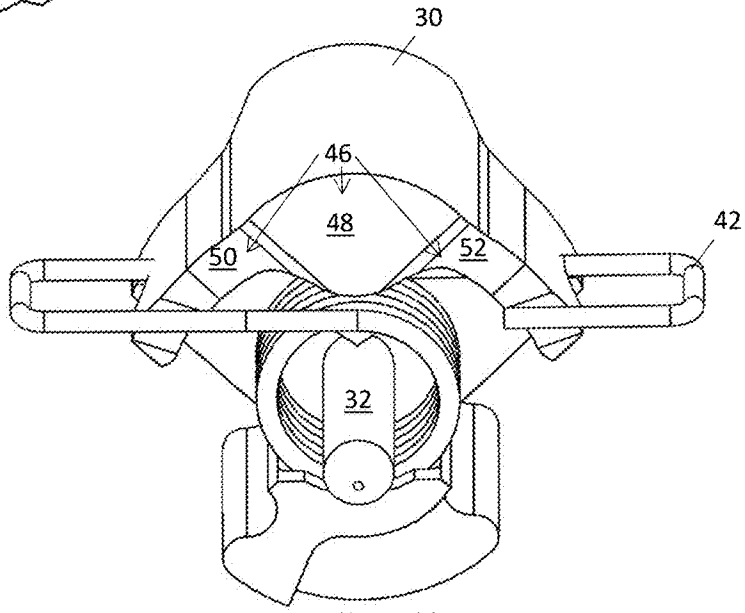
FIG. 19 shows a front isometric view of the side of the shackle stop actuator of FIG. 11 mounted on a pivot pin, and a torsion spring operationally coupled to the shackle stop actuator.
Figure 17:
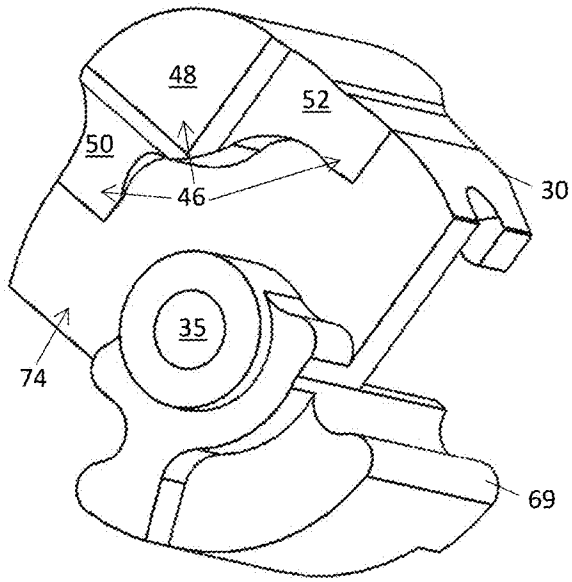
FIG. 17 shows an isometric view of a side of a shackle stop actuator of the padlock of FIG. 1.

FIGS. 17 to 19, for example, show a lateral side 74 of the shackle stop actuator 30. The side 74 is associated with the end 27 ("the toe") of the shackle 18. The shackle stop actuator 30 comprises a lateral cam surface 46 configured to move the shackle stop 24 to the shackle stop receiver 22. Shown in FIGS. 4,5,9,11, for example, the shackle stop 24 is captured within the shackle stop receiver 22 by the lateral cam surface 46 and so cannot move out of the shackle stop receiver 22. The lateral cam surface 46 comprises a capture surface 48 for capturing the shackle stop 24 within the shackle stop receiver 22, which is flanked by flanking surfaces 50, 52 inwardly displaced relative to the capture surface and which are contiguous with the capture surface 48.

As shown in FIG. 5, for example, the shackle stop 24 is movably disposed in a conduit 66 defined by the body 12 and having a first conduit opening 59 and a second conduit opening 68, which are at opposite ends of the conduit 66. In the present by not necessarily all embodiments, the shackle stop 24 has a clearance fit with respect to the conduit 66. The shackle stop receiver 22 is positionable at the first conduit opening 59 and when so positioned the shackle stop 24 is movable along the conduit 66 and into receipt by the shackle stop receiver 22, whereby the shackle stop 24 is disposed in the groove 72, for immobilising the shackle 18. When so disposed, the shackle stop 24, being constrained by the interior walls defining conduit 66 interferes with the shackle stop receiver wall 73 (FIG. 29, for example) to stop removal of the shackle toe 27 from shackle receiving passage 31 defined by the body 12 of the padlock 10. The shackle stop 24 interferes with the other shackle stop receiver wall 75 to stop further insertion of the shackle toe 27 into the shackle receiving passage 31.

Figure 16:
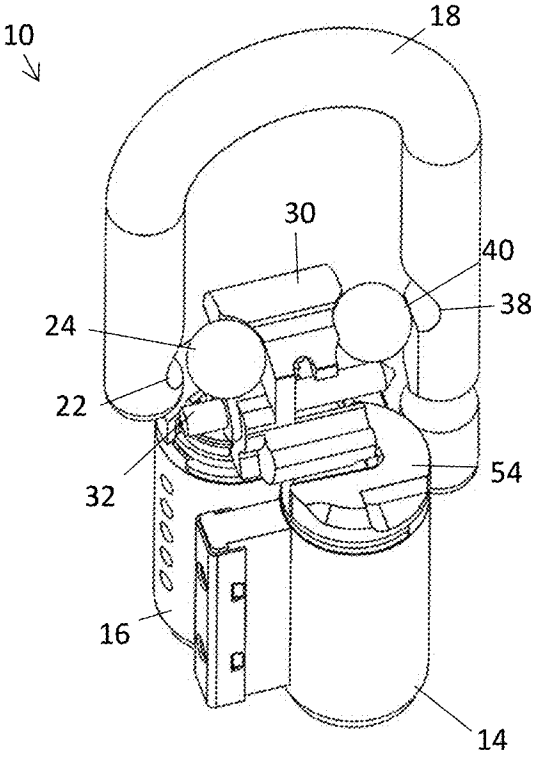
FIGS. 14, 15 and 16 show the arrangement of internal components of the padlock of FIG. 1 in an unlocked state, with the shackle partially extended outwardly.
Figure 15:
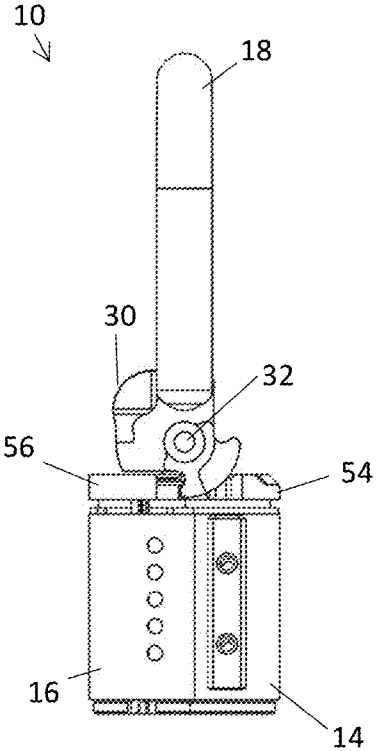
Figure 14:
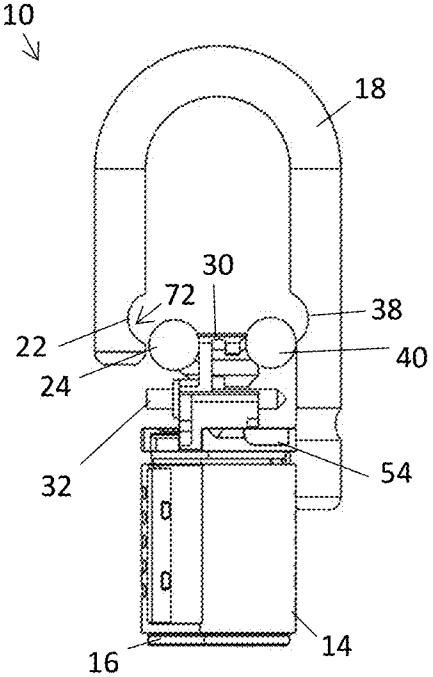

FIGS. 14 to 16 show the arrangement of internal components of the padlock of FIG. 1 in an unlocked state, with the shackle partially extended outwardly. In the unlocked state, the shackle stop 24 can be inwardly moved along the conduit 66, and so removed from the shackle stop receiver 22.

Figure 24:
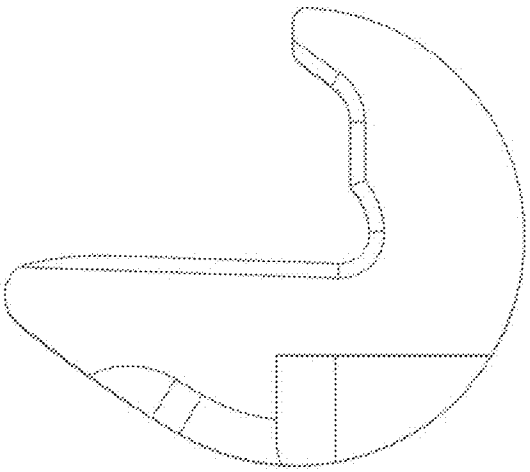
FIG. 24 shows a view from above of an alternative example of a cylinder lock cam which does not have a substantially more circular section shape.

The padlock 10 comprises a plurality of cylinder lock cams 54, 56, one of which is shown in FIGS. 16 and 17 for example. In the present but not all embodiments the plurality of cylinder lock cams 54,56 have substantially the shape of a major circular sector. The major circular sector has a central angle of approximately 250 to 290 degrees, however it may be lesser or greater in alternative embodiments. Cylinder lock cam 54 comprises a camming surface 57 that is followed by a cam follower surface 69 (FIG. 17, for example) of the shackle stop actuator 30. FIG. 24 shows a view from above of an alternative example of a cylinder lock cam which does not have a substantially more circular section shape.

Figure 23:
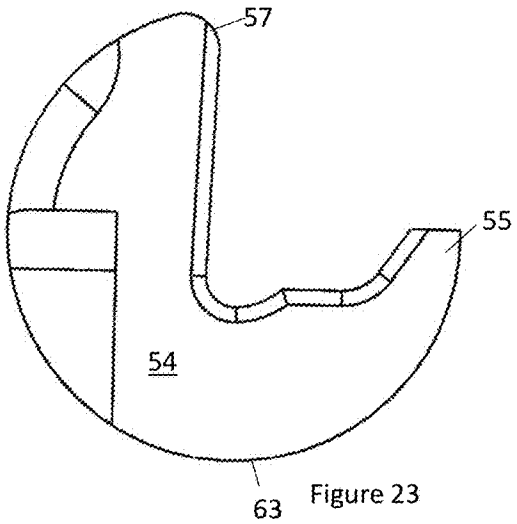
FIG. 23 shows a view from above of the cylinder lock cam of FIG. 22.
Figure 22:
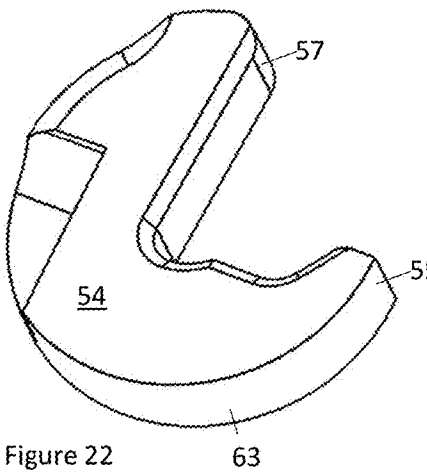
FIG. 22 shows an isometric view of one of the two cylinder lock cams of FIGS. 18 and 14.
Figure 27:
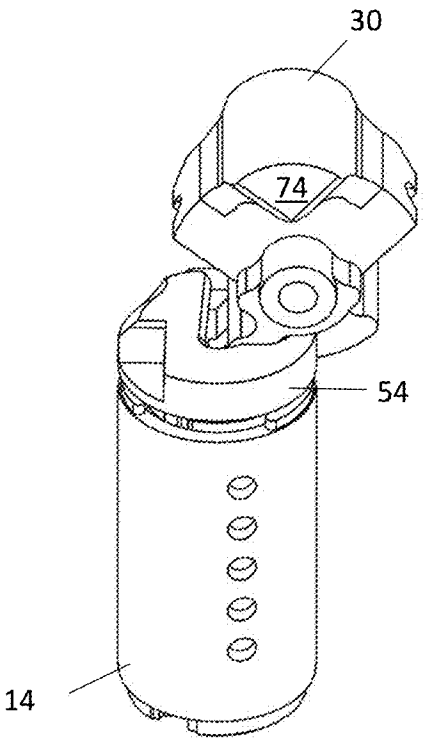
FIGS. 25 to 27 show elevational, and isometric views of a cylinder lock being operated to actuate one of the two cylinder lock cams and the shackle lock actuator.
Figure 26:
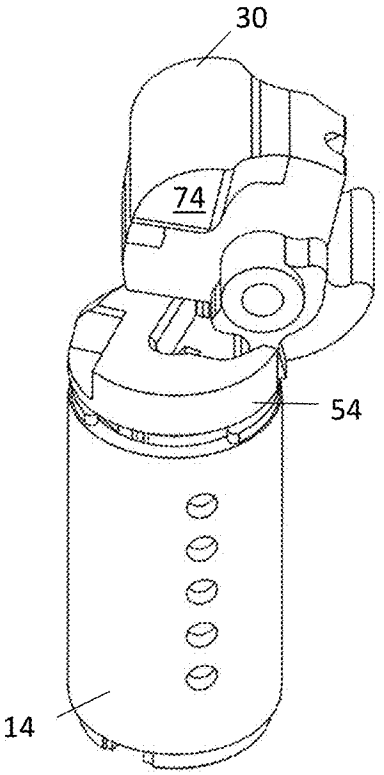
Figure 25:
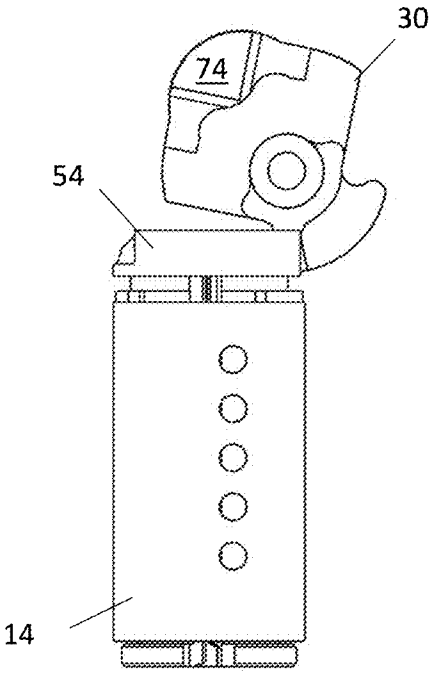

The plurality of cylinder lock cams 54,56 are receivable within the plurality of cylinder lock cavities defined by the body 12. As shown in FIGS. 25 to 27, for example, each of the plurality of cylinder lock cams 54,56 when so received are operable coupled to the plurality of cylinder locks 14,16 and operable by the plurality of cylinder locks 14,16 to pivot the shackle stop actuator 30. Cylinder lock cam 54 has a finger 55, as shown in FIGS. 22 and 23 for example. Finger 55 is at the outer perimeter 63 of the cylinder lock cam 54 and is oriented perpendicularly to longitudinal axis 100, 102 of the associated cylinder lock 12,16. Finger 55 is for a key retention function, as described in further detail below. Finger 55 and camming surface 57 are at opposite sides the cylinder lock cam 54.

This but not all embodiments of a padlock 10 comprise the plurality of cylinder locks 14,16, which are disposed in the plurality of cylinder lock cavities, to which a plurality of cylinder lock cams 54,56 are actuatably coupled thereto. One of the two identical cylinder lock cams 54 is shown in detail in FIGS. 22 and 23. The shackle stop actuator 30 is cooperatively arranged with each of the plurality of cylinder lock cams 54, 56 for pivoting the shackle stop actuator 30. The distance between the lateral cam surface 46 and the shackle 18 when the stop actuator 30 is at one of the other pivot position (FIGS. 25 and 26, for example) on either side of the central pivot position (FIG. 27, for example) is greater than that when the stop actuator 30 is at the central pivot position. When in the other pivot position, the shackle stop 22 can be inwardly along the conduit 66, and so removed from the shackle stop receiver 22, but not when the stop actuator 30 is in the pivot position, in which case the stop actuator 30 interferes with inward movement of the shackle stop 22. Yet another position similar or identical to the pivot position is on the other side of the central position.

Figure 20:
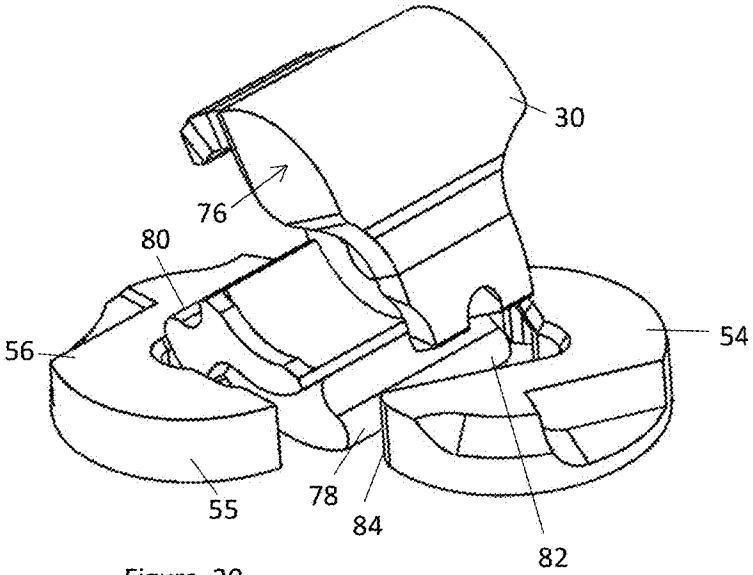
FIG. 20 shows an isometric view of another side of the shackle stop actuator of FIG. 11, and the two cylinder lock cams, the other side being opposite the side shown in FIGS. 17 to 19.

The lateral cam surface 46 is configured to move the shackle stop 24 to the first conduit opening 59 when the shackle stop actuator 30 is pivoted from one of the plurality of pivot positions, for example the other pivot position shown in FIGS. 25 and 26, to another one of the plurality of pivot positions, for example the pivot position shown in FIG. 20. When the shackle stop actuator 30 is so pivoted, the sloping flanking surfaces 50 push the shackle stop 24 outwardly along the conduit 66.

FIG. 20, for example, shows a follower engager 84 of the cylinder lock cam 54 rotated into engagement with one of a plurality of cam following surfaces 78,80 of the shackle stop actuator 30. Rotational actuation of the shackle stop actuator 30 by the engaged cylinder lock cam 54 causes the shackle stop engager 30 to pivot around the pivot axis 34 through the centre aperture 35 of the shackle stop actuator 30. The plurality of cylinder lock cam following surfaces 78,80 are on opposite sides of the shackle stop actuator 30, and each comprise a rounded elongated edge surface 82 that is parallel, in this but not necessarily in all embodiments, to the pivot axis 34. The cam following surfaces 78,80 delimit an exterior arcuate surface orientated perpendicularly to the pivot axis 34, the exterior actuate surface clearing the non-engaged cylinder lock cam 56 when pivoted by the engaged cylinder lock cam 54.

Figure 21:
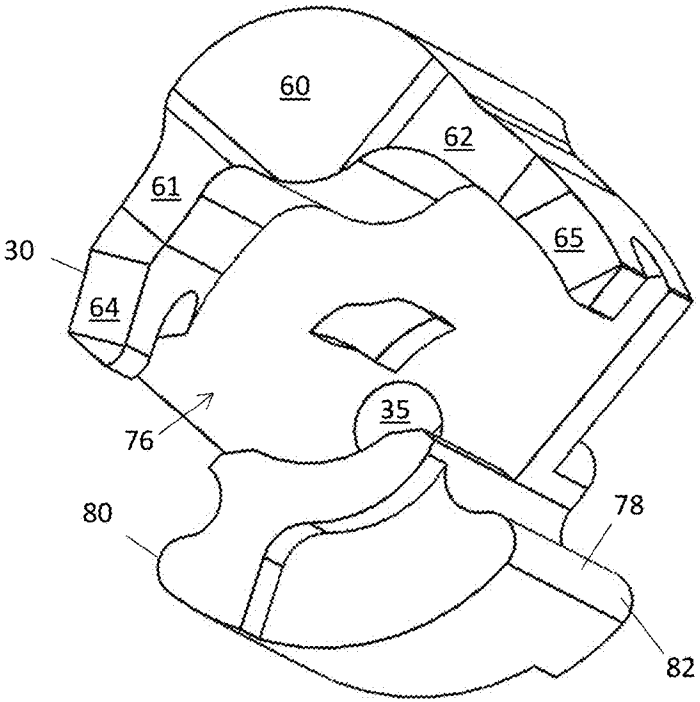
FIG. 21 shows another isometric view of the other side of the shackle stop actuator of FIG. 11.
Figure 29:
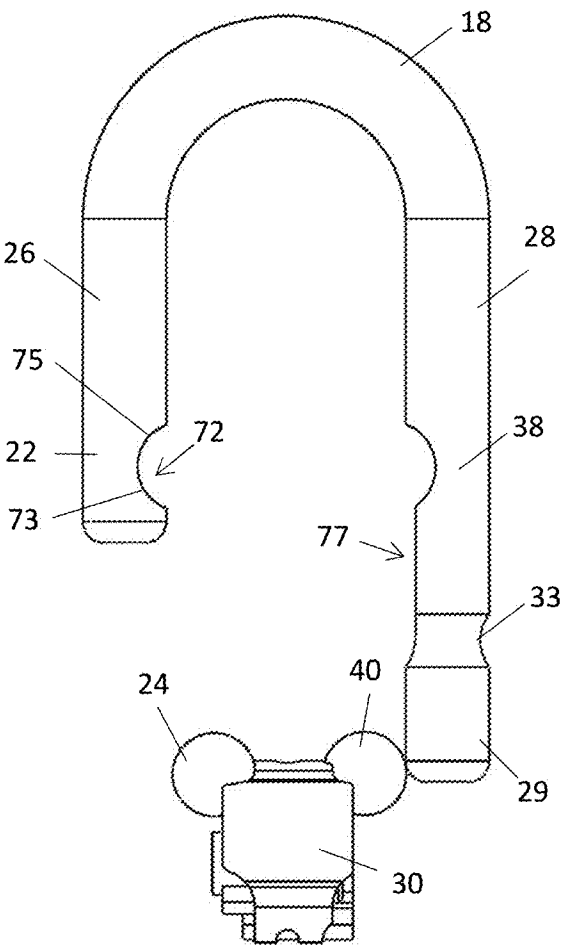
FIG. 29 corresponds to FIG. 28 and shows a side elevational view of some of the internal components of the padlock of FIG. 1 in a disassembly state.
Figure 28:
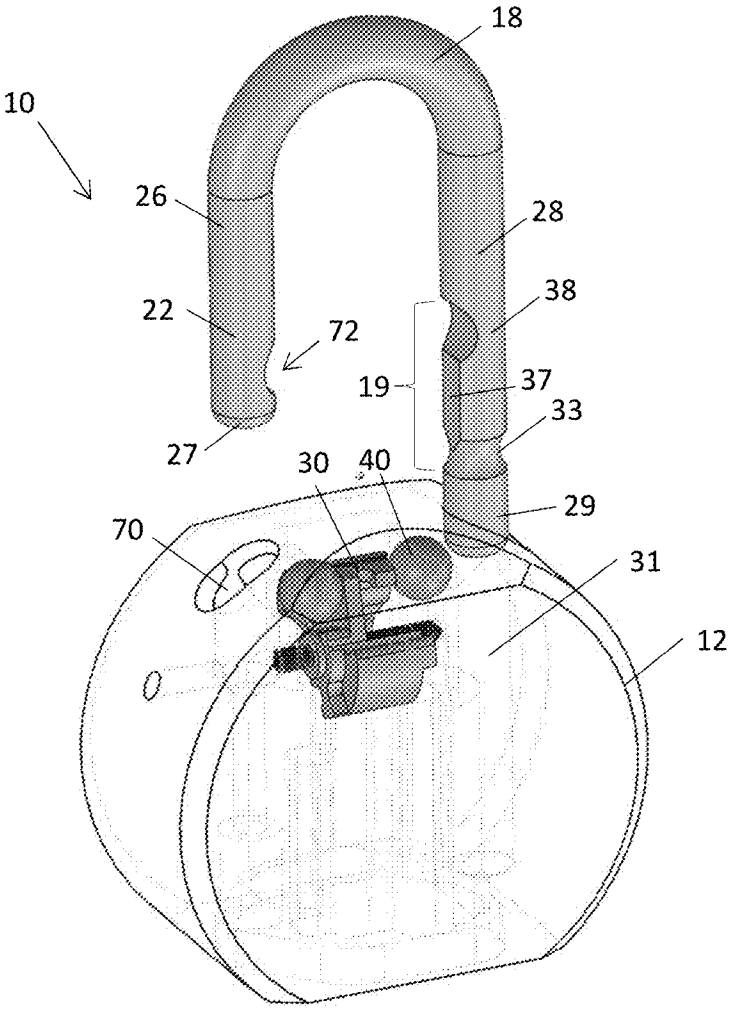
FIG. 28 shows an isometric view of the arrangement of the internal components of the padlock of FIG. 1 in an disassembly state in which the shackle can be separated from the body, wherein a padlock body is shown transparently for illustrative purposes and some part are not shown.

The body 12 defines another conduit 58, shown in FIG. 5 for example, in which is movably disposed another shackle stop 40 that can interact with another lateral side 76 of the shackle stop actuator 30. FIGS. 20 and 21, for example, show isometric views of the other side 76 of the shackle stop actuator 30. The other side 76 is associated with the end 29 ("the heel") of the shackle 18, which in not generally removed from the padlock 10 when the padlock 10 is merely unlocked and subsequently locked. Feature 60 of side 76 corresponds to feature 48 of other side 74, and features 61,62 of side 76 correspond to features 52 and 50 of side 74. Other stop 40 is moved into receipt by the cam stop receiver 38 when the feature 60 is positioned at the opening 59 (FIG. 5, for example) of other conduit 58. Features 64 and 65 of side 76 are at the opening 59 of other conduit 58 when the shackle stop actuator is at a fourth position and a fifth position of the plurality of positions for removing the shackle 18 from the body, as shown in FIGS. 28 and 29. The feature corresponding to the fifth position also indicated by numeral 64 is in the present but not necessarily in all embodiments similar or identical to the fourth position 64, but on the other side of the first or central position. Concave features 62 and 64 are inwardly displaced relative to surface 60, and feature 64 more so than feature 62. The shackle 18 can be rotated but not removed when the feature 62 is at an opening 68 (FIG. 5) of another conduit 58. The shackle 18 can be removed when either one of the features 64 is at an opening 57 of the other conduit 58.

As shown in FIG. 28, for example, arm 28 of shackle 18 comprises a recessed surface 19 defining a shackle stop receiving cavity 77 (FIG. 29, for example). The shackle stop 40 is held within the shackle stop receiving cavity 77 by the shackle stop actuator 30 when either one of surfaces 61,62 (FIG. 21) of the shackle stop actuator 30 is at the 57 (FIG. 5, for example), but not when either one of surfaces 64 and 65 of the shackle stop actuator 30 is at the opening 57. The arm 28 cannot be removed from the body 12 when the shackle stop 40 is held within the shackle stop receiving cavity 77 by the shackle stop actuator 30. When the shackle stop 40 is held within the shackle stop receiving cavity 77, the arm 28 is prevented from spinning within passageway 31 when shackle stop 40 engages flat surface portion 37 opposite shackle stop engager 22, enabling the end 27 to be guided into the aperture 70. When the padlock is open, surface 37 interferes with outward movement of the shackle stop 40, which in turn interferes with and prevents the shackle stop actuator 30 being biased into the central or locking pivot position and the lock cylinder having a received key being moved to a rotary configuration for which the received key can be removed therefrom. The shackle 18 is ready to be snap-locked. From this configuration, when the shackle is moved inwardly the shackle stops 24,40 engage the shackle stop receivers 72,38 and shackle stop 40 ceases to interfere with the shackle stop actuator 30 being biased into the central or locking pivot position. With the movement of the shackle stop actuator 30 by the bias, the cylinder lock cam 54,56 associated with the lock cylinder having the received key is moved by the shackle stop actuator 30, and in turn the cylinder lock cam moves the lock cylinder having a received key into a rotary configuration for which the received key can be removed therefrom. To remove the arm 28 from the body 12, the shackle stop actuator 30 is pivoted to dispose either one of the surfaces 64 and 65 at the opening 57, in which case the shackle stop actuator 30 ceases to interfere with removal of the arm 28 from the shackle stop receiving cavity 77. Adjacent end 29 is waist 33 of arm 28, the waist being configured to receive shackle top 40. The shackle 18 can spin within shackle receiving passage 31 when shackle stop 40 is received within waist 33 and the shackle 18 is retained within the body 12 by the shackle stop 40.

Each of the plurality of cylinder lock cams 54,56 are cooperatively arranged with their respective cylinder lock 14,16 to be rotated into contact, specifically a finger 55 thereof, with a lateral side 74,76 of the shackle stop actuator 30. When finger 55 of a cylinder lock cam 54,56 is so in contact with a lateral side 74,76, the shackle stop actuator 30 interferes with a rotation of a cylinder lock cam because the finger 55 cannot penetrate the lateral side 74,76. Contact between finger 55 and the lateral side 76 occurs at the same time as a key is captured by the cylinder lock 14,16 and the stop actuator 30 is at the other pivot position. This may prevent removal of the key when the padlock is unlocked, as in the present embodiment. A cam without a finger 55 may be used if this key retention feature is not desired.

Variations and/or modifications may be made to the embodiments described without departing from the spirit or ambit of the invention. For example:

- One embodiment may be configured to receive two cylinder locks on one or each side of the shackle stop actuator, that is a total of three or four cylinder locks.
- The shackle stop may alternatively comprise a rod, pin or generally have any suitable and desired from.
- The shackle stop receiver may alternatively define a bore or a dimple for, for example, receiving the shackle stop.
- The conduits may be in the form of rails, guides or generally any suitable and desired form.
- The body may be configured for the cylinder locks to be inserted through one or more sides, not through the base, of the padlock body.
- The shackle may have an angular or squared end.
- The arms of the shackle may not be parallel, and may diverge.
- The body may be substantially spherical or generally have any suitable shape.
- Parts described as comprising metal or steel may alternatively or additionally comprise composite materials and/or polymers as suitable and desired.
- The cylinder lock cams may not be identical.
- The cylinder locks may alternatively not be removable from the body.
- The cylinder lock cam following surfaces may not be parallel to the pivot axis of the shackle stop actuator.

Now that embodiments have been described, it will be appreciated that some embodiments have some of the following advantages:

- The plurality of cylinder locks can be for a plurality of entities or parties. Each entity or party can hold an associated key, and change the coding of their cylinder lock without seeking another parties' cooperation and without changing the other entity's or party's access.

Each of the plurality of cylinder locks may be replaced as needed or desired.

The key may not be removed when the padlock is unlocked.

The use of one or more shackle stops may improve strength and/or resistance to tampering.

The shackle may be removed and replaced with a different shackle configuration, for example a different length.

While the locking mechanism described above has been done with reference to a padlock the invention is not limited to a padlock and may be implemented in other form factors. For example, the locking mechanism may be implemented in a door handle, padlock, puck lock etc. The locking mechanism may also be implemented as a type of interchangeable core capable of being installed in a multitude of different form factors.

The present embodiments are to be considered in all respects as illustrative and not restrictive. Reference to a feature disclosed herein does not mean that all embodiments must include the feature.

In the claims which follow and in the preceding description of the invention, except where the context requires otherwise due to express language or necessary implication, the word "comprise" or variations such as "comprises" or "comprising" is used in an inclusive sense, that is to specify the presence of the stated features but not to preclude the presence or addition of further features in various embodiments of the invention.

The invention claimed is:

1. A padlock comprising:

a movably housed shackle stop;

a shackle that is movably mounted and comprising two arms and a shackle stop receiver for receiving the shackle stop to immobilize the shackle;

a shackle stop actuator pivotable around a laterally extending pivot axis and comprising a lateral cam surface configured to outwardly move the shackle stop into receipt by the shackle stop receiver;

a body configured to simultaneously receive a plurality of cylinder locks for actuation of the shackle stop actuator by any one of the plurality of cylinder locks and define a plurality of cylinder lock cavities for receiving the plurality of cylinder locks; and wherein a longitudinal axis extending through an axis of rotation of each of the plurality of cylinder locks is offset from the laterally extending pivot axis of the shackle stop actuator and wherein each longitudinally extending rotational axis and the laterally extending pivot axis are nonparallel and do not intersect.

2. A padlock defined by claim 1 comprising the plurality of cylinder locks and comprising a plurality of cylinder lock cams, wherein:

the shackle stop is movably disposed in a conduit having a first conduit opening and a second conduit opening, the shackle stop receiver is positionable at the first conduit opening and when so positioned the shackle stop is movable along the conduit into receipt by the shackle stop receiver for immobilizing the shackle, wherein the lateral cam surface is configured to move the shackle stop to the first conduit opening, and each of the plurality of cylinder lock cams are cooperatively arranged with their respective cylinder lock to be in contact with the shackle stop actuator at the same time as the respective cylinder lock has captured a key and the shackle stop actuator is at the second conduit opening.

3. A padlock defined by claim 1 comprising a plurality of cylinder lock cams receivable by the body and each of the plurality of cylinder lock cams when so received are operable by the plurality of cylinder locks, when so received by the body, to pivot the shackle stop actuator, wherein each of the plurality of cylinder lock cams comprise a finger for contact with the shackle stop actuator.

4. A padlock defined by claim 3 wherein the finger is perimetrically located.

5. A padlock defined by claim 4 comprising the movably housed shackle stop, wherein one arm comprises the shackle stop receiver and the other arm comprises another shackle stop receiver for receiving the other shackle stop and immobilizing the shackle.

6. A padlock defined by claim 5 wherein the two arms are perpendicular to a laterally extending pivot axis.

7. A padlock defined by claim 6 wherein a longitudinal axis of each of the plurality of cylinder lock cavities are substantially perpendicular to the laterally extending pivot axis.

8. A padlock defined by claim 7 wherein the plurality of cylinder locks are removably fixed within the plurality of cylinder lock cavities.

9. A padlock defined by claim 8 wherein the shackle stop comprises a ball.

10. A padlock defined by claim 4 wherein:

the shackle stop is movably disposed in a conduit having a first conduit opening and a second conduit opening;

the shackle stop receiver is positionable at the first conduit opening and when so positioned the shackle stop is movable along the conduit into receipt by the shackle stop receiver for immobilizing the shackle;

wherein the lateral cam surface is configured to move the shackle stop to the first conduit opening.

11. A padlock defined by claim 10 comprising the plurality of cylinder lock cams receivable by the body and each of the plurality of cylinder lock cams when so received are operable by the plurality of cylinder locks, when so received by the body, to pivot the shackle stop actuator.

12. A padlock defined by claim 11 wherein each of the plurality of cylinder lock cams comprise a camming surface followed by the shackle stop actuator.

13. A padlock defined by claim 12 comprising the plurality of cylinder locks to which the plurality of cylinder lock cams are actuatably coupled thereto, wherein the shackle stop actuator is cooperatively arranged with each of the plurality of cylinder lock cams for pivoting the shackle stop actuator.

14. A padlock defined by claim 13 wherein the shackle stop actuator is pivotable between a first position and a second position wherein the distance between the lateral cam surface and the second conduit opening when the stop actuator is at the second position is greater than that when the stop actuator is at the first position.

15. A padlock defined by claim 14 comprising a biasing element cooperatively coupled to the shackle stop actuator, and which biases the shackle stop actuator to the first position.

16. A padlock defined by claim 15 wherein the shackle stop actuator is pivotable to a third position wherein the distance between the lateral cam surface and the second conduit opening when the shackle stop actuator is at the third position is greater than that when the shackle stop actuator is at the first position.

17. A padlock defined by claim 16 wherein the shackle stop actuator is pivotable to the second position by operation by one of the plurality of cylinder lock cavities.

18. A padlock defined by claim 17 wherein the plurality of cylinder lock cams comprise a plurality of follower engages and the shackle stop actuator comprises a plurality of cylinder lock cam following surfaces.

19. A padlock defined by claim 18 wherein the plurality of cylinder lock cam following surfaces are rounded, elongated and on opposite sides of the shackle stop actuator.

* * * * *